United States Patent [19]

Wurster

[11] 4,163,171

[45] Jul. 31, 1979

[54] HALOGEN CYCLE INCANDESCENT LAMP

[75] Inventor: Ewald Wurster, Grünwald, Fed. Rep. of Germany

[73] Assignee: Patent-Treuhand Gesellschaft fur Electrische Glumlampen mbH, Munich, Fed. Rep. of Germany

[21] Appl. No.: 845,536

[22] Filed: Oct. 26, 1977

[30] Foreign Application Priority Data

Nov. 2, 1976 [DE] Fed. Rep. of Germany ..... 2650298

[51] Int. Cl.[2] ..... H01K 1/32; H01K 1/50

[52] U.S. Cl. ..... 313/221; 313/222

[58] Field of Search ..... 313/222, 221

[56] References Cited

U.S. PATENT DOCUMENTS

| | | | |
|---|---|---|---|
| 3,270,237 | 8/1966 | Danko | 313/220 |
| 3,496,401 | 2/1970 | Dumbaugh, Jr. | 313/222 X |
| 3,644,776 | 2/1972 | DeCaro | 313/222 X |
| 3,648,094 | 3/1972 | DeCaro et al. | 313/222 X |
| 3,681,640 | 8/1972 | Martin | 313/222 |
| 3,712,701 | 1/1973 | Johnston et al. | 313/222 X |
| 3,728,572 | 4/1973 | Maier et al. | 313/222 |
| 3,848,152 | 11/1974 | Schultz | 313/221 |
| 4,005,324 | 1/1977 | Dolenga et al. | 313/222 |

OTHER PUBLICATIONS

"Materials and Techniques for Electron Tubes", by W. H. Kohl, (1966), Table 1.4, p. 26.

*Primary Examiner*—Palmer C. Demeo

*Attorney, Agent, or Firm*—Frishauf, Holtz, Goodman & Woodward

[57] ABSTRACT

An incandescent lamp having a hard glass envelope, a tungsten filament, and an inert gas fill containing a halogen or halide additive. The hard glass envelope contains substantially no alkali or carbon monoxide and is preferably devoid of these materials. The hard glass contains less than 0.03% by weight of water and less than 0.1 $\mu$ liter/g carbon dioxide dissolved therein.

7 Claims, 1 Drawing Figure

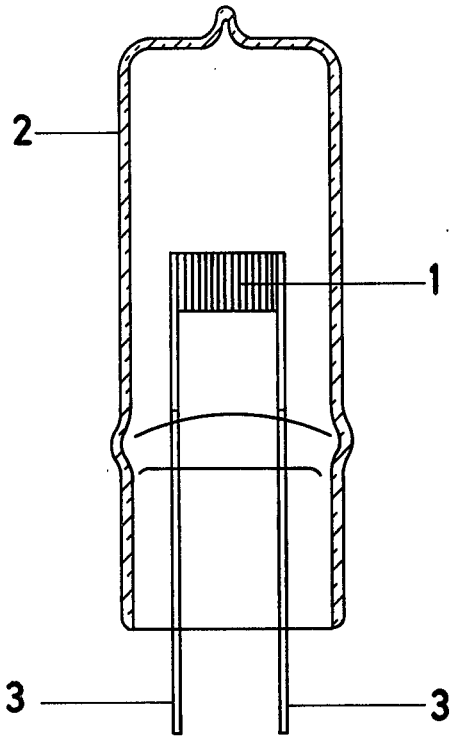
2
1
3
3

HALOGEN CYCLE INCANDESCENT LAMP

BACKGROUND OF THE INVENTION

The present invention provides incandescent lamp-shaving a tungsten filament with a glass lamp bulb, preferably hard glass, with the lead wires hermetically embedded and thereby sealed in the glass. The lamp has an inert gas fill including a halogen additive, e.g., bromine or HBr, and functions with a regenerative cycle. During operation the partial pressure of the halogen functions so that the tungsten particles evaporated off the filament are captured so that they do not reach the glass of the lamp bulb. Instead, they are returned to the filament. Incandescent lamps with a regenerative cycle remain unblackened throughout their service life. As a consequence, their luminous efficacy remain substantially constant during their service life. Lamps of this type are known, for example, see U.S. Pat. No. 3,418,512.

During the manufacture of such incandescent lamps, a specified quantity of a brominated hydrocarbon, such as dibromomethane, is added to the inert gas fill. The brominated hydrocarbon is subsequently thermally decomposed by heat within the lamp bulb, upon initial lighting of the lamp. The decomposition may even occur earlier while passing the gaseous mixture through the exhaust tube when the lamp is being filled. In addition to the brominated hydrocarbon, a specified quantity of carbon oxide may be added to the inert gas fill. A quantity of from 0.05 to 0.5 volume percent of carbon oxide is feasible, see DT-OS No. 2,046,186.

Hard glass useful in the manufacture of the lamp bulb of such incandescent lamps is resistant to high temperature, see, for example, the German published application No. P 26 01 576.9 filed on Jan. 16, 1976 which corresponds to U.S. application Ser. No. 755,189 filed on Dec. 29, 1976, now abandoned in favor of Ser. No. 869,494, filed Jan. 16, 1978, which discloses borosilicate hard glass. Such hard glass is resistant to operating temperatures of above 700° C. They usually contain sodium among other components. The glass has dissolved therein carbon oxide, carbon dioxide, and water. Such materials may be introduced into the glass melt, for example, as moist air when preparing the powdered glass batch constituents; in the form of gaseous decomposition products, for example, steam and carbon dioxide, of the glass batch constituents which are not added as the oxide but as the hydrate, hydrated salt, carbonate, etc.; and lastly gases which diffuse into the fused glass, such as for example, adsorption of combustion or combustible gases. During operation of the lamp such materials diffuse out of the glass into the lamp bulb and may adversely affect the regenerative cycle, thereby reducing the service life of the lamp. Carbon monoxide, carbon dioxide, and water which speed up the regenerative cycle, and/or hydrogen and sodium and potassium which slow down the regenerative cycle, may be released during the operation of the lamp and the composition of the fill gas may be subject to an unwanted change.

The materials which speed up the regenerative cycle cause noticeable transport of tungsten and molybdenum which can be distinguished from surface roughness and dendrite growth on the internal lamp components. When the quantity of substances which speed up the regenerative cycle is small, then it is possible to compensate for the negative influence on the lamp's service life by a selection of the amount of the halogen additive such that it minimizes the said negative affect. The substances which slow down the regenerative cycle have a getter effect on the halogen additive within the lamp. Thus, when an alkali, for example, sodium, is present, stable sodium halogen compounds are formed which precipitate. With a sufficiently large amount of sodium present, this finally leads to a sufficient deficiency in the amount of halogen available so that the regenerative cycle breaks down with consequent blackening of the lamp. Although it would be possible to postpone the breakdown of the regenerative halogen cycle by using an excess amount of halogen in the lamp, the result of the excess amount of halogen present would be excessive functioning of the regenerative cycle. As a consequence, the more it is attempted to postpone the onset of lamp blackening in this manner, the sooner will the lamp become unserviceable as a consequence of the excess rate of the regenerative cycle.

It is an object of the present invention to prevent the reduction in service life of such lamps by minimizing or preventing the inclusion in the hard glass of the lamp bulb of substances which speed up or slow down the regenerative cycle and which might diffuse into the interior of the lamp during operation.

THE INVENTION

The present invention provides an incandescent lamp having a tungsten filament with a lamp bulb comprising hard glass having lead wires hermetically embedded therein. The lamp contains an inert gas filling and a halogen additive. The hard glass bulb contains substantially no alkali or carbon monoxide. The hard glass bulb contains less than 0.03% by weight of $H_2O$ and less than 0.1 $\mu$liter/g of $CO_2$.

SHORT DESCRIPTION OF THE DRAWING

The drawing is a sectional view of an incandescent lamp of the present invention.

The drawing discloses an incandescent lamp comprising a lamp bulb 2 composed of hard glass. Lead wires 3, for example, of molybdenum, are hermetically embedded therein. The lead wires 3 are connected to the coiled tungsten filament 1. The interior of the sealed lamp contains an inert gas filling which also contains dibromomethane, and optionally if desired, 0.2 volume percent of carbon monoxide. The hard glass of the lamp bulb is substantially devoid of alkali and CO and contains dissolved therein less than 0.03% by weight of $H_2O$ and less than 0.1 $\mu$liter/g of $CO_2$.

It has been found that the presence of specified amounts of the substituents which speed up the regenerative cycle may be tolerated if such specified amounts are either extremely small or are small and of a constant quantity. Substances which slow down the regenerative cycle should be eliminated entirely to the extent that this is possible in commercial operation.

Hard glass useful for the lamp bulbs specified herein may be prepared utilizing a glass batch containing constituents (components) which do not contain alkali or carbon compounds. Alkali-free refining agents should only be used during the manufacture of the glass. No carbon should be added. Preferably, the glass is melted in an electrically heated furnace having a suitable inert gas atmosphere. Alternately, it may be feasible to melt the glass under conventional conditions and then to subject it to a suitable after treatment.

The hard glass composition preferred for the lamp bulbs is glass No. 943, manufactured by OSRAM GmbH, München/Berlin. Its components, the substances dissolved therein and the amounts (in weight percent) are as follows:

| | | | |
|---|---|---|---|
| $SiO_2$ | 50.0% | $H_2O$ | <0.03% |
| $B_2O_3$ | 5.0% | $CO_2$ | <0.1 μliter/g |
| $P_2O_5$ | 4.8% | CO | <0.1 μliter/g |
| $Al_2O_3$ | 19.2% | $H_2$ | <not measurable |
| MgO | 4.4% | | |
| CaO | 5.8% | | |
| BaO | 10.8% | | |
| Alkali content: Na <0.3%, K <0.3%. | | | |

I claim:

1. An incandescent lamp comprising a hermetically sealed hard glass envelope encasing a tungsten filament connected to lead wires hermetically sealed in said hard glass and containing an inert gas filling together with a halogen additive, said hard glass envelope consisting essentially of hard glass selected from the group consisting of aluminosilicate hard glass and borosilicate hard glass which contains substantially no alkali and carbon monoxide, and contains less than 0.03% by weight of water and less than 0.1 μliter/g carbon dioxide dissolved therein.

2. The incandescent lamp of claim 1 wherein said hard glass contains substantially no sodium.

3. The incandescent lamp of claim 2 wherein the gas filling includes dibromomethane which in service provides the halogen additive.

4. The incandescent lamp of claim 3 wherein said gas fill contains 0.2 volume percent of carbon monoxide.

5. The incandescent lamp of claim 1 wherein said hard glass is an aluminosilicate glass.

6. The incandescent lamp of claim 5, wherein said aluminosilicate also contains boron.

7. The incandescent lamp of claim 1 wherein said hard glass is a borosilicate glass.

* * * * *